US008770137B2

(12) United States Patent
Kuo

(10) Patent No.: US 8,770,137 B2
(45) Date of Patent: Jul. 8, 2014

(54) STRUCTURE OF TRAFFIC CONE

(75) Inventor: Shu-Nan Kuo, Ho Mei Township, Changhua County (TW)

(73) Assignee: Jing Nan Traffic Engineering Co., Ltd., Changhua County (TW)

( * ) Notice: Subject to any disclaimer, the term of this patent is extended or adjusted under 35 U.S.C. 154(b) by 348 days.

(21) Appl. No.: 13/346,253

(22) Filed: Jan. 9, 2012

(65) Prior Publication Data

US 2013/0174775 A1 Jul. 11, 2013

(51) Int. Cl.
*E01F 9/012* (2006.01)

(52) U.S. Cl.
USPC ..... 116/63 C

(58) Field of Classification Search
CPC ..... E01F 9/012; E01F 9/0122; E01F 9/0124; E01F 13/02; E01F 13/04
USPC ..... 116/63 C, 63 P; 404/6, 9, 10
See application file for complete search history.

(56) References Cited

U.S. PATENT DOCUMENTS 3,247,823 A * 4/1966 Buck et al. ..... 116/63 R
3,451,368 A * 6/1969 Keats ..... 116/63 R
6,929,419 B1 8/2005 Kuo
7,056,055 B1 6/2006 Kuo
7,338,229 B1 3/2008 Kuo
2008/0011221 A1* 1/2008 Dvoracek ..... 116/63 C

FOREIGN PATENT DOCUMENTS

AU 2013100564 A4 * 5/2013 ..... E01F 9/012
GB 2077332 A * 12/1981 ..... B60Q 7/00
TW 300685 U * 11/2006 ..... E01F 9/012
TW 341714 U * 10/2008 ..... E01F 9/012
TW 384208 U * 7/2010 ..... E01F 9/012
TW 434793 U * 8/2012 ..... E01F 9/012

* cited by examiner

*Primary Examiner* — R. A. Smith

(57) ABSTRACT

The present invention is a traffic cone, mainly to utilizes a two-stage formation manufacturing method in which a cone body is injected for combing with a preformed base, wherein the periphery of a through hole having a large dimension and formed at the center of the base is extended with a cone ring part having a preset height, and the upper portion of the cone ring part is formed with a combination part having reduced inner and outer diameter, a preset quantity of convex columnar members are arranged on the inner and the outer surfaces of the combination part with equal intervals, and a fluid passing hole is respectively formed between adjacent convex columnar member, the original material of cone body flows pass the inner and the outer sides of the combination part through the fluid passing holes and combines with the convex columnar member.

6 Claims, 5 Drawing Sheets

STRUCTURE OF TRAFFIC CONE

BACKGROUND OF THE INVENTION

1. Field of the Invention

The present invention relates to an improved structure of traffic cone, mainly for lowering the production cost of traffic cone, with the design of the periphery of a through hole at the center of a preformed base being upwardly extended with a cone ring part and the installation of convex columnar members and fluid passing holes, a tightly combing effect can be obtained while a cone body being combined with a combination part of the base with an injection molding means, also the used quantity of secondary material or recycled material for the base can be increased thereby relatively reducing the used quantity of original material for the cone body, so the production cost can be further lowered and the industrial application and the economical benefits are provided.

2. Description of Related Art

A conventional traffic cone is formed by a plastic or rubber material processed with an injection molding means, and generally has two portions, a cone body and a base extended at the bottom, wherein the base is served to provide stability while the traffic cone being placed, and the cone body is served to provide an warning effect. With said design, the main function of the cone body is to utilize the bright color of the material itself to achieve the warning effect with the illumination of vehicle lamps at nighttime, and for the stability of placement, the base is formed with various counterweight for meeting the requirements of various occasions and regulation or law issued by different regions.

However, said integral manufacturing of traffic cone utilizes single material, and is often limited by the formation configuration of traffic cone, so the thickness of cone body is thin but has a large volume; in order to ensure the material can be fully filled in the mold within a preset formation time, the material has to adopt a material have better fluidity for injection molding, and in order to obtain a better color warning effect, the original material for injection molding has to adopt a virgin material with better quality, and a secondary material or recycled material is not suitable to be used, therefore the whole production cost cannot be lowered. As such, skilled people in the art have been trying to manufacture a traffic cone by stages. Take the U.S. Pat. No. 6,929,419 and the U.S. Pat. No. 7,056,055 for examples, a cone body is firstly formed by a cone body mold for injection molding, then is disposed in a base mold for the combination and formation of a base. The U.S. Pat. No. 7,338,229 B1 issued to the inventor of the present invention has disclosed a method in which a base is firstly formed, and the middle portion of a through slot having a large dimension and formed at the center of the base is extended with a convex ring part having a proper width and formed with plural dovetail holes, then the base is disposed in an integral traffic cone formation mold for the injection molding of a cone body; by adopting a material having high fluidity for the cone body allows the dovetail holes preformed on the base to flow through for combining with the convex ring part, thereby finishing the manufacturing and combination of the base and the cone body. In view of said two manufacturing methods of traffic cone by stages, it looks like the only difference is the formation stage of the base and the cone body, however in actual practice, the former one is to firstly form a cone body by injection molding which is limited by the specification configurations, so an original material having better fluidity is required for the operation of injection molding, and during the injection molding of the base, a virgin material having high fluidity has to be used for combing with a combination ring seat preformed on the cone body, so the material cost is not able to be effectively reduced; and the later one is to firstly form a base then combine with a cone body by injection molding, so the base can adopt a lower-cost material such as a secondary material or recycled material, and the cone body still adopts the cone body original material having high fluidity for the injection molding; as a result, the material cost for the base is lowered thereby greatly reducing the whole production cost, and better industrial application and economical benefits are provided.

However, the inventor of the present invention does not just satisfy with his invented by-stage manufacturing method of firstly forming a base then disposing the base in a mold for the injection molding of a cone body for the purpose of lowering production cost; without affecting the anticipated function of traffic cone, the inventor wants to further reduce the material cost for relatively increasing the financial profits and providing better industrial application and economical benefits.

SUMMARY OF THE INVENTION

In view of the current manufacturing of traffic cone, the inventor of the present invention has found some room for further reducing the whole production cost, with his continuous research and years of experience in the related industries, the improved structure of traffic cone is provided, wherein one primary objective is to, with a novel structure design, further increase the used quantity of secondary material or recycled material in the manufacturing of a base then processing the injection molding of a cone body for combination, as such, the required original material for the cone body can be relatively reduced thereby achieving the objective of reducing material cost.

Another objective of the present invention is to, with a novel structure design, ensure the combination stability of a cone body and a base under the circumstance that the used quantity of secondary material or recycled material for the base being increased, thereby providing better industrial application and economical benefits.

For achieving the mentioned objectives, the present invention is to utilize a secondary material or recycled material to manufacture a base, and the periphery of a through hole having a large dimension and formed at the center of the base is extended with a cone ring part having a preset height, and the upper portion of the cone ring part is formed with a combination part having reduced inner and outer diameter, a preset quantity of convex columnar members are arranged on the combination part with equal intervals, and a fluid passing hole is respectively formed between adjacent convex columnar members, with the installation of the convex columnar members and the fluid passing holes, when the base is disposed in a mold for the injection molding of a cone body, the original material of cone body having better fluidity is enabled to flow pass the inner and the outer sides of the combination part through the fluid passing holes and combine with the convex columnar members, thereby obtaining a tightly combing effect between the cone body and the base, and with the installation of the cone ring part and the combination part of the base, more secondary material or recycled material is used for further lowering the production cost while the preset specification of traffic cone is met, thereby providing excellent industrial application and economical benefits.

Figure 1:
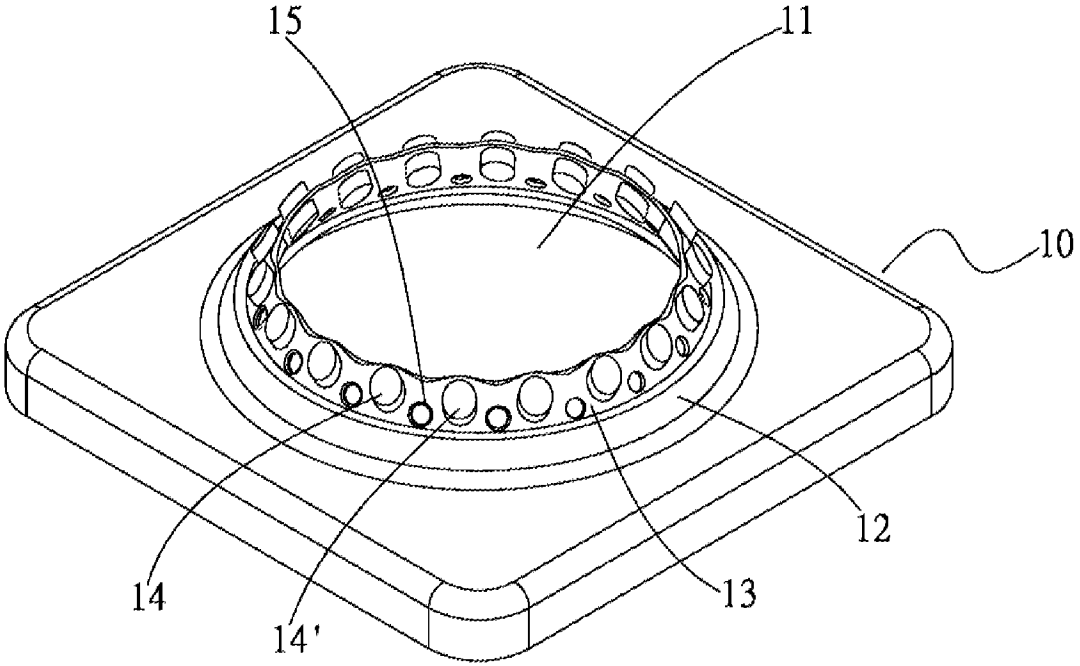
FIG. 1 is a schematic structural view showing the base of the traffic cone, according to one preferred embodiment of the present invention.

CODE (1) moveable die holder
(2) fixed mold
(3) moveable die
(10) base
(11) through hole
(12) cone ring part
(13) combination part
(14)(14') convex columnar member
(15) fluid passing hole
(16) positioning slot
(20) cone body

DETAILED DESCRIPTION OF THE PREFERRED EMBODIMENT

Figure 2:
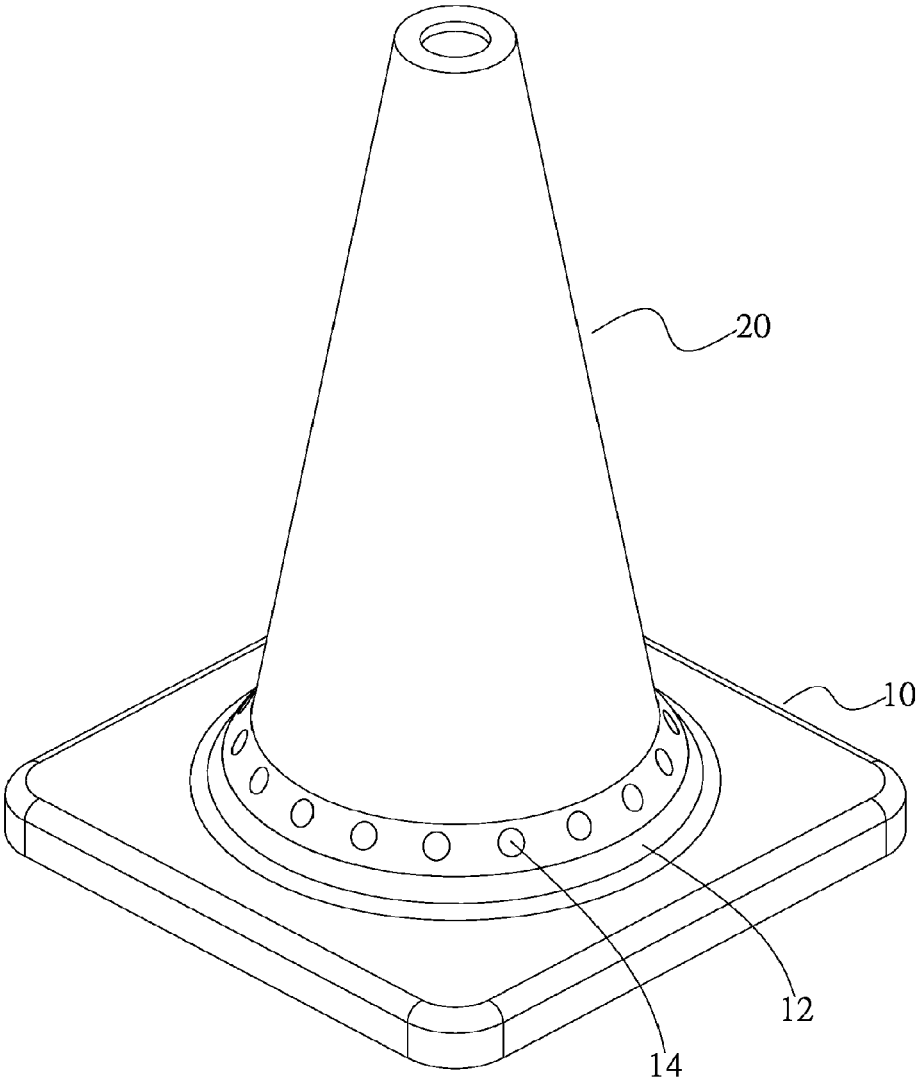
FIG. 2 is a schematic structural view showing the traffic cone, according to one preferred embodiment of the present invention.
Figure 3:
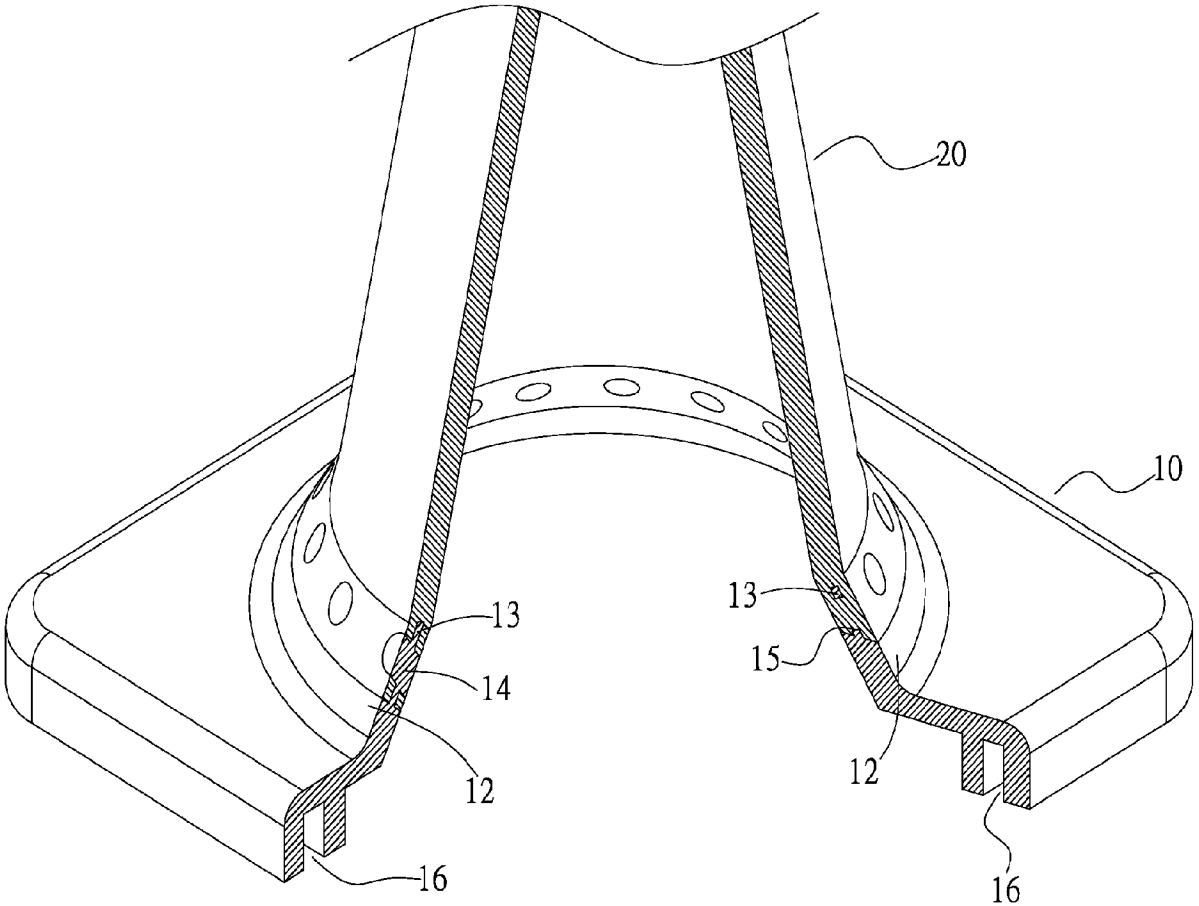
FIG. 3 is a schematic view illustrating the structure relation of the traffic cone, according to one preferred embodiment of the present invention.
Figure 4:
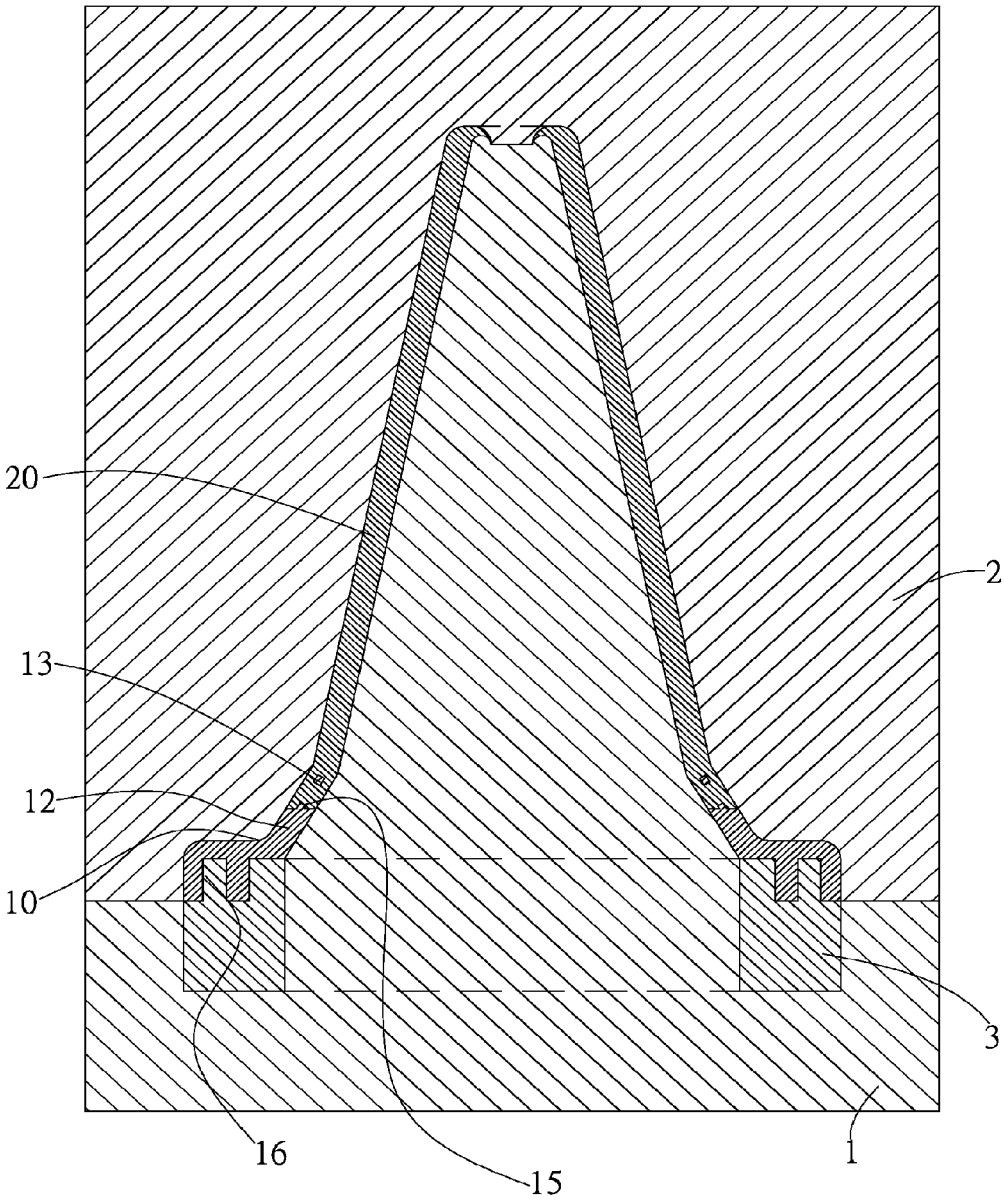
FIG. 4 is a schematic view illustrating the manufacturing relation of the traffic cone, according to one preferred embodiment of the present invention.
Figure 5:
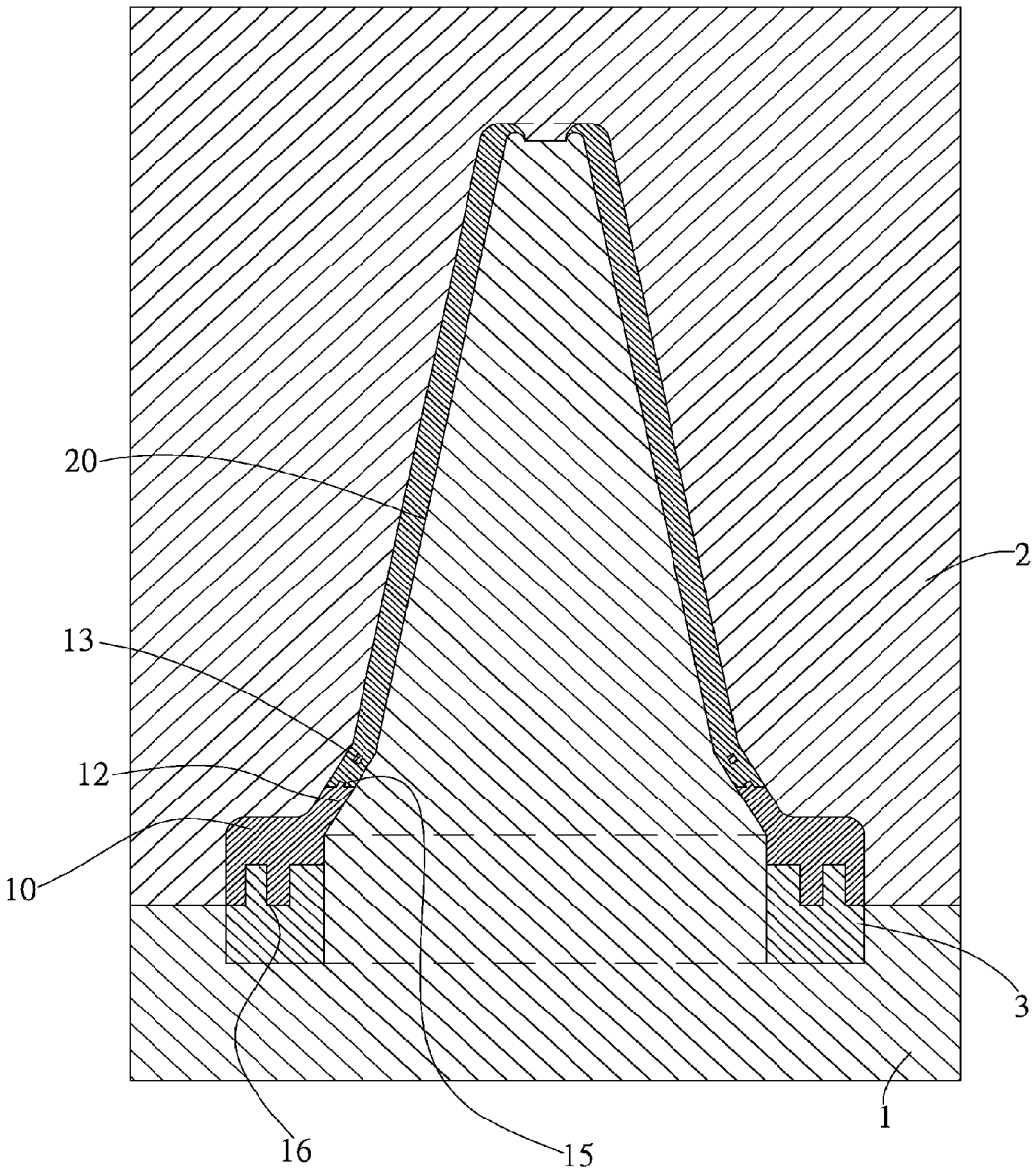
FIG. 5 is a schematic view illustrating the manufacturing relation of the traffic cone, according to another preferred embodiment of the present invention.

The accompanying drawings are included to provide a further understanding of the invention, and are incorporated in and constitute a part of this specification. The drawings illustrate embodiments of the invention and, together with the description, serve to explain the principles of the invention, wherein FIG. 1 is a schematic structural view showing the base of the traffic cone, according to one preferred embodiment of the present invention; FIG. 2 is a schematic structural view showing the traffic cone, according to one preferred embodiment of the present invention; FIG. 3 is a schematic view illustrating the structure relation of the traffic cone, according to one preferred embodiment of the present invention; FIG. 4 is a schematic view illustrating the manufacturing relation of the traffic cone, according to one preferred embodiment of the present invention; and FIG. 5 is a schematic view illustrating the manufacturing relation of the traffic cone, according to another preferred embodiment of the present invention.

As shown in figures, the structure design of the traffic cone provided by the present invention is composed by manufacturing a base (10) and a cone body (20) of the traffic cone by stages then assembling the above two, such that the base (10) is preformed then disposed in an integral traffic cone formation mold for processing the injection molding of the cone body (20).

According to the present invention, the base (10) can be formed with various counterweight by a base mold which is additionally prepared, with respect to actual needs; because the main function of the base (10) is for counterweight, a lower-cost material such as a secondary material having poorer fluidity or recycled material can be adopted in the manufacturing, and the center of the base (10) is formed with a through hole (11) having a large dimension, the periphery of the through hole (11) is upwardly extended with a cone ring part (12) having a preset height and taper which is matched with the taper that the cone body (20) is desired to be formed with, the upper portion of the cone ring part (12) is formed with a combination part (13) having reduced inner and outer diameter, so the top edge of the combination part (13) is formed as a non-planar state with wave-like configurations, and the circumference of the combination part (13) is formed with convex columnar members (14) with a predetermined quantity and arranged with equal intervals, wherein the convex columnar members (14) can be correspondingly installed at the outer surface, the inner surface or both of the inner and the outer surfaces of the combination part (13), and end surfaces of the convex columnar members (14) are also matched with the taper that the cone body (20) is desired to be formed with, a fluid passing hole (15) is formed between adjacent convex columnar members (14), (14'), meanwhile the bottom surface of the base (10) is provided with a positioning slot (16).

According to the disclosed structural configuration of the traffic cone provided by the present invention, the base (10) is preformed then combined with the cone body (20) through an injection means, wherein the cone body (20) is formed through a virgin material having better fluidity processed with an injection molding means, the quality and the warning effect of the finished product are not affected, and the base (10) does not play a substantially important role for the purpose of warning but mainly provided for counterweight to enable the traffic cone to be stably placed. In addition, the base (10) is combined with the cone body (20), therefore the material of the base (10) does not require a material having high fluidity, and the base (10) can be formed through a secondary material having poorer fluidity or recycled material processed with an injection molding means, thereby greatly reducing the material cost of the base (10); moreover, with a design in which the cone ring part (12) being upwardly extended from the periphery of the through hole (11) at the center of the base (10), the used quantity of secondary material or recycled material can be further increased without affecting the overall operational function of the traffic cone, thereby relatively reducing the quantity of virgin material required by the injection molding of the cone body (20), therefore the whole material cost can be lowered to a certain extent, and the production cost can be further decreased, also better industrial application and economical benefits are provided.

The manufactured base (10) is disposed in a moveable die holder (1) of an integral traffic cone formation mold, and a moveable die (3) installed inside the moveable die holder (1) is engaged with the positioning slot (16) at the bottom surface of the base (10) thereby being mounted and positioned, then the moveable die holder (1) is operated to displace towards a cone body fixed mold (2) for mold engagement, then a virgin material with better fluidity is adopted for the injection molding of the cone body (20). During the injection molding of the cone body (20), because the adopted material has better fluidity, the adopted material is enabled to flow through the fluid passing holes (15) preformed on the combination part (13) at the upper portion of the cone ring part (12) of the base (10) for being combined with the inner and the outer sides of the combination part (13), thereby obtaining a combination relation between the base (10) and the cone body (20); with the installation of the convex columnar members (14) and the fluid passing holes (15), and the top edge of the combination part (13) being in a non-planar configuration, an extremely-tightened mounting and combining effect is formed while the cone body (20) is combined with the combination part (13) of the base (10), thereby preventing the cone body (20) from releasing from the base (10) and achieving the by-staged manufacturing and forming process of the traffic cone of the present invention.

According to the disclosed structural configuration of the traffic cone provided by the present invention, the base (10) is preformed then combined with the cone body (20) through an injection means, wherein the cone body (20) is formed through a virgin material having better fluidity processed with an injection molding means, the quality and the warning effect of the finished product are not affected, and the base (10) does not play a substantially important role for the purpose of warning but mainly provided for counterweight to enable the traffic cone to be stably placed. In addition, the base (10) is combined with the cone body (20), therefore the material of the base (10) does not require a material having high fluidity, and the base (10) can be formed through a secondary material having poorer fluidity or recycled material processed with an injection molding means, thereby greatly reducing the material cost of the base (10); moreover, with a design in which the cone ring part (12) being upwardly extended from the periphery of the through slot (11) at the center of the base (10), the used quantity of secondary material or recycled material can be further increased without affecting the overall operational function of the traffic cone, thereby relatively reducing the quantity of virgin material required by the injection molding of the cone body (20), therefore the whole material cost can be lowered to a certain extent, and the production cost can be further decreased, also better industrial application and economical benefits are provided.

Based on the traffic cone structure invented by the inventor of the present invention, the base is further extended with a cone ring part having a preset height for increasing the used quantity of lower-cost secondary material or recycled material, and relatively reducing the used quantity of more-expensive virgin material having better fluidity required by the injection molding of the cone body, so the material cost can be lowered, meanwhile with the structural design of the combination part at the upper portion of the cone ring part and the convex columnar members and the fluid passing holes, the injection molding and combination of the cone body is provided with an extremely-tightened combing effect, so the present invention provides economical benefits for the industrial application and also provides great quality and practical utilization, therefore this invention is a novel and outstanding design which has yet to be seen in the marketplace.

As what is disclosed above, the present invention aims at improving the structural design of a traffic cone, with the design of the through hole at the center of the base being extended with a cone ring part and incorporating with the installation of the convex columnar members and the fluid passing holes of the combination part, the used quantity of lower-cost secondary material or recycled material can be increased while keeping the tightly combing effect between the cone body and the base, so the whole production cost can be relatively lowered. The present invention provides the industrial application of manufacturing a traffic cone by stages, and further increases the economical benefits while the practicability is still kept. Therefore this invention can solve the disadvantages of conventional art and is a novel and outstanding design.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. An improved structure of traffic cone, mainly to manufacture a base and a cone body of the traffic cone by stages, so the base is firstly preformed, then disposed in a mold for the injection molding of the cone body, the base is able to be formed with various counterweight according to actual needs, and the bottom surface of the base is formed with a positioning slot for positioning the mold, characterized in that:

a through hole having a large dimension is formed at the center of the base, the periphery of the through hole is upwardly extended with a cone ring part having a preset height and taper, the upper portion of the cone ring part is formed with a combination part having reduced inner and outer diameter, a preset quantity of convex columnar members are installed at the circumference of the combination part and arranged with equal intervals, and a fluid passing hole is respectively formed between adjacent convex columnar members, when the cone body is injected for combing with the combination part of the base, the original material of the cone body is allowed to flow pass the inner and the outer sides through the fluid passing holes and obtain a tightly combing relation with the convex columnar members.

2. The improved structure of traffic cone according to claim 1, wherein the convex columnar members are correspondingly installed at the outer surface, the inner surface or both of the inner and the outer surfaces of the combination part of the base.

3. The improved structure of traffic cone according to claim 1, wherein the cone ring part of the base is matched with the taper that the cone body is desired to be formed with.

4. The improved structure of traffic cone according to claim 1, wherein end surfaces of the convex columnar members are matched with the taper that the cone body is desired to be formed with.

5. The improved structure of traffic cone according to claim 1, wherein the top edge of the combination part of the base is formed as a non-planar state with wave-like configurations.

6. The improved structure of traffic cone according to claim 1, wherein the base is manufactured and formed by a secondary material having poorer fluidity or recycled material.

* * * * *